US010710136B2

(12) United States Patent
Ogawa et al.

(10) Patent No.: US 10,710,136 B2
(45) Date of Patent: Jul. 14, 2020

(54) PRESS-FORMING APPARATUS AND PRESS-FORMING METHOD

(71) Applicant: NIPPON STEEL & SUMITOMO METAL CORPORATION, Tokyo (JP)

(72) Inventors: Misao Ogawa, Tokai (JP); Masaru Itoh, Shioya-gun (JP); Toshiya Suzuki, Amagasaki (JP); Hiroyuki Tanoue, Nagoya (JP); Yasuharu Tanaka, Nagoya (JP)

(73) Assignee: NIPPON STEEL CORPORATION, Tokyo (JP)

( * ) Notice: Subject to any disclaimer, the term of this patent is extended or adjusted under 35 U.S.C. 154(b) by 281 days.

(21) Appl. No.: 15/569,617

(22) PCT Filed: May 11, 2016

(86) PCT No.: PCT/JP2016/063976
§ 371 (c)(1),
(2) Date: Oct. 26, 2017

(87) PCT Pub. No.: WO2016/181986
PCT Pub. Date: Nov. 17, 2016

(65) Prior Publication Data

US 2018/0126433 A1 May 10, 2018

(30) Foreign Application Priority Data

May 11, 2015 (JP) ..... 2015-096908

(51) Int. Cl.
*B21D 5/00* (2006.01)
*B21D 5/01* (2006.01)
(Continued)

(52) U.S. Cl.
CPC ..... *B21D 5/01* (2013.01); *B21D 22/26* (2013.01); *B21D 53/88* (2013.01)

(58) Field of Classification Search
CPC ..... B21D 5/01; B21D 22/21; B21D 22/22; B21D 22/26; B21D 37/08
See application file for complete search history.

(56) References Cited

U.S. PATENT DOCUMENTS

2014/0356643 A1* 12/2014 Nakata ..... B21D 22/26 428/603
2015/0336619 A1 11/2015 Tanaka et al.
(Continued)

FOREIGN PATENT DOCUMENTS

CN 101786122 A 7/2010
JP 59-99032 U 7/1984
(Continued)

OTHER PUBLICATIONS

Russian Office Action and Search Report, dated Oct. 19, 2018, for counterpart Russian Application No. 2017138531, with English translations.
(Continued)

*Primary Examiner* — Debra M Sullivan
(74) *Attorney, Agent, or Firm* — Birch, Stewart, Kolasch & Birch, LLP

(57) ABSTRACT

This press-forming apparatus is a press-forming apparatus for manufacturing a press-formed article from a workpiece sheet by moving at least one of a die and a punch so as to be close to each other in a press-forming direction, the press-formed article having a top portion, a first sidewall portion, and a second sidewall portion, the first sidewall portion and the second sidewall portion being connected to ridge portions formed on both edges of the top portion, wherein the die includes: a die slide; a first divisional die; a second divisional die; a second divisional die driving unit; a die pad; a die pad driving unit; an insert block; and an insert block driving unit.

19 Claims, 13 Drawing Sheets

(51) Int. Cl.
*B21D 22/26* (2006.01)
*B21D 53/88* (2006.01)

(56) References Cited

U.S. PATENT DOCUMENTS

| | | | | |
|---|---|---|---|---|
| 2015/0367392 | A1 | 12/2015 | Nishimura et al. | |
| 2016/0121384 | A1 | 5/2016 | Sumikawa et al. | |
| 2017/0333972 | A1* | 11/2017 | Nishimura ..... | B21D 5/01 |

FOREIGN PATENT DOCUMENTS

| | | | |
|---|---|---|---|
| JP | 60-103518 | U | 7/1985 |
| JP | 10-94839 | A | 4/1998 |
| JP | 2001-252721 | A | 9/2001 |
| JP | 2004-167593 | A | 6/2004 |
| JP | 2005-95937 | A | 4/2005 |
| JP | 2012-51005 | A | 3/2012 |
| RU | 776712 | A1 | 11/1980 |
| RU | 1329868 | A1 | 8/1987 |
| RU | 2057606 | C1 | 4/1996 |
| TW | 201501830 | A | 1/2015 |
| WO | WO 2014/106932 | A1 | 7/2014 |
| WO | WO 2014/208181 | A1 | 12/2014 |

OTHER PUBLICATIONS

International Search Report for PCT/JP2016/063976 dated Jul. 5, 2016.

Notice of Allowance for JP 2016-555806 dated Dec. 6, 2016.

Office Action for TW 105114583 dated Aug. 29, 2017.

Written Opinion of the International Searching Authority for PCT/JP2016/063976 (PCT/ISA/237) dated Jul. 5, 2016.

Chinese Office Action dated Aug. 1, 2018, issued in Chinese Patent Application No. 201680026702.4.

* cited by examiner

PRESS-FORMING APPARATUS AND PRESS-FORMING METHOD

TECHNICAL FIELD OF THE INVENTION

The present invention relates to a press-forming apparatus and a press-forming method for a high strength and/or long size press-formed article, which is used for a structure member of a vehicle body such as a side sill or a floor cross member.

Priority is claimed on Japanese Patent Application No. 2015-096908, filed on May 11, 2015, the content of which is incorporated herein by reference.

RELATED ART

As is widely known, automotive bodies have a so-called monocoque structure configured by a body shell having a box type structure as a basic structure in which a plurality of formed panels are overlapped and joined at each of edge portions; and a reinforcement framework member joined to the box type structure at a specific portion such as a portion applied with a stress and a portion loaded by a heavy object. As an example of such framework members, there is a side sill which is joined to both edge portions in the automotive width direction of a floor panel. The side sill is a close sectional member assembled by overlapping and welding a side sill outer panel, a side sill inner reinforcement arranged if required, and a side sill inner panel, which are press-formed article, at flange portions formed at end portions of these members.

FIG. 8A is a perspective view showing an example shape of a side sill inner panel 0 constituting the side sill, and FIG. 8B is a plan view showing an example shape of the side sill inner panel 0.

As shown in FIG. 8A and FIG. 8B, the side sill inner panel 0 is generally manufactured by press-forming a material (blank) of a steel sheet by using a punch and a die, so as to obtain a press-formed article with a hat type cross-section configured by the following portions (a) to (e).

(a) top portion 0-1

(b) two ridge portions 0-2*a*, 0-2*b*, which are formed on both edges of the top portion 0-1

(c) two sidewall portions 0-3*a*, 0-3*b*, which connect to each of the two ridge portions 0-2*a*, 0-2*b*

(d) two bending portions 0-4*a*, 0-4*b*, which connect to each of the two sidewall portions 0-3*a*, 0-3*b*

(e) two flange portions 0-5*a*, 0-5*b*, which connect to each of the two bending portions 0-4*a*, 0-4*b*

It should be noted that a recessed portion 0-6 is formed on the top portion 0-1 of the side sill inner panel 0 shown in FIG. 8A and FIG. 8B. However, the top portion 0-1 may be formed with a shape other than the recessed portion 0-6, and the top portion 0-1 may have a planar shape without such a specific shape.

In addition, the term "press-formed article with a substantially U shaped cross-section" used in this specification means a part including at least the above portions (a), (b), and (c). Further, the term "press-formed article with a hat type cross-section" is a part in which a bending portion and a flange portion are added to the "press-formed article with a substantially U shaped cross-section".

For the side sill, there is a tendency of higher strength and thinner thickness as an approach of a vehicle weight saving for achieving further reduction of $CO_2$ emission and improving collision safety properties. Therefore, for example, a side sill having a high strength of not less than 980 MPa has been used, and recently, even a side sill having a ultra-high strength of not less than 1180 MPa with a thickness of 1.2 mm has been demanded. On the other hand, to cope with an enlargement of vehicle bodies and an integration of parts, demands for higher strength and/or longer size of the side sill are increased. Therefore, as exemplified in FIG. 8B, it is considered to use, as a blank, a galvannealed steel sheet (GA steel sheet) having a thickness of 1.2 mm, a tensile strength of not less than 1180 MPa, and a total length of about 2200 mm.

For the mass-production of such high strength and/or long size side sill inner panel or a side sill outer panel on an industrial scale, following means (i) and (ii) may be considered.

(i) performing a roll forming by a sequential bending processing by using a plurality of forming rolls linearly arranged through which a strip material is continuously passed, and final rolls for obtaining a product with a desired cross-section.

(ii) performing a press-forming using a transfer press-machine having a fingering mechanism that grips a strip used as a blank in a multi-stage forming tool placed on a press bolster, and a transfer mechanism that conveys the gripped strip.

However, in a case of using the above (i), the productivity by the roll forming is low as compared to a press forming, and further, it is impossible to manufacture a formed product in which a cross sectional shape varies along the longitudinal direction. Accordingly, by the roll forming method, it is not easy to realize a mass production of the side sill inner panel or the side sill outer panel with high strength and/or long size.

On the other hand, in a case of the above (ii), for the mass-production of the side sill inner panel or the side sill outer panel with high strength and/or long size, it is necessary to perform press-forming by using, for example, 2500 tons class transfer press machine. Accordingly, if the blank having a tensile strength of 1180 MPa and a thickness of 1.2 mm is used, the maximum length of the blank is limited to about 1700 mm, and thus, there is a problem in a forming load and a producible length.

Further, when a ultra-high strength blank having a tensile strength of not less than 980 MPa is press-formed by using a punch and a die, a portion in the blank formed to be a sidewall portion is subject to a bending/unbending deformation by the punch and the die in a process of press-forming, therefore, a bending moment is generated at the press-formed sidewall portion. Then, when a formed product is removed from a forming tool and the pressure applied by the punch and the die is released, a spring back tends to occur which is a phenomenon that two sidewall portions becomes an opened shape from a shape (product shape) when a load has been applied, due to an elastic deformation recovery.

FIG. 9A to FIG. 9D are explanation diagrams showing an invention of Patent Document 1 in a time line.

Though Patent Document 1 is not directly directed to a manufacturing of a side sill inner panel or a side sill outer panel, Patent Document 1 discloses an invention for manufacturing a high strength press-formed article with hat type cross-section while suppressing a spring back of sidewall portions, by using a bending processing tool 1000 equipped with a punch 1002, a die 1003, a flange bending tool 1008, and a blank holder 1006. More specifically, the press-formed article is manufactured by:

(1) a first step of placing a blank 1001 on the bending tool 1008, as shown in FIG. 9A, (2) a second step of forming a flange portion by using a flange bending tool so as to bend end portions of the blank 1001 in the width direction in a state where portions in the blank 1001 to be formed into the sidewall portions are clamped by the die 1003 and the blank holder 1006, as shown in FIG. 9B, (3) a third step of moving away the blank holder 1006 from a position adjacent to the portion in the blank 1001 to be formed into the sidewall portion toward a lower direction by a cylinder 1009, as shown in FIG. 9C, and (4) a fourth step of forming the sidewall portion by performing a bending processing using the die 1003 and the punch 1002, as shown in FIG. 9D.

It should be noted that, in FIG. 9A to FIG. 9D, a reference number 1004 indicates a shoulder portion of the punch 1002, a reference number 1005 indicates a shoulder portion of the die 1003, a reference number 1007 indicates a hat-head portion pad member, and a reference number 1010 indicates a pipework for driving the cylinder 1009.

PRIOR ART DOCUMENT

[Patent Document]

[Patent Document 1] Japanese Unexamined Patent Application, First Publication No. 2004-167593

DISCLOSURE OF THE INVENTION

Problems to be Solved by the Invention

The invention disclosed in Patent Document 1 forms the sidewall portions by lowering a pair of the dies 1003 simultaneously, and thus, a forming load becomes excessive. Accordingly, for example, in order to press-form a blank with a tensile strength of not less than 980 MPa and a length of longer than 1700 mm, it is impossible to realize an accurate press-forming by using a conventional 1200 tons class press-forming facility. Therefore, it is necessary to employ a new press-forming apparatus that can exhibit high pressing load, such as 2500 tons class. Therefore, the cost for the facility increases.

Further, the invention disclosed in Patent Document 1 rises and lowers the blank holder 1006 by using the cylinder 1009 arranged under the flange bending tool 8. Accordingly, the height of the press-forming apparatus increases in order to secure a stroke range for raising and lowering the blank holder 6.

The present invention has been made in view of the above problems of these related art, and an objective of the present invention is to provide a press-forming apparatus and a press-forming method that can manufacture a high strength and/or long size press-formed article while suppressing the excessive amount of the maximum press-forming load and the excessive size of the press-forming apparatus in the press-forming direction.

Means for Solving the Problem

The present invention employs the following means.

(1) A first aspect of the present invention is a press-forming apparatus for manufacturing a press-formed article from a workpiece sheet by moving at least one of a die and a punch so as to be close to each other in a press-forming direction, the press-formed article having a top portion, a first sidewall portion, and a second sidewall portion, the first sidewall portion and the second sidewall portion being connected to ridge portions formed on both edges of the top portion, wherein the die includes: a die slide; a first divisional die arranged at the die slide so as to be adjacent to a first side face of the punch in a state where the die and the punch are the closest to each other; a second divisional die arranged at the die slide so as to be adjacent to a second side face of the punch in a state where the die and the punch are the closest to each other, the second side face being an opposite side face of the first side face; a second divisional die driving unit configured to move the second divisional die in the press-forming direction so as to separate the second divisional die from the die slide; a die pad arranged between the first divisional die and the second divisional die; a die pad driving unit configured to move the die pad in the press-forming direction; an insert block having a base end portion configured to be inserted between the die slide and the second divisional die in a state where the die slide and the second divisional die are separated from each other; and an insert block driving unit configured to move the insert block in a direction perpendicular to the press-forming direction.

(2) In the press-forming apparatus in the above (1), the insert block may have a tip end portion which extends from the base end portion to the direction perpendicular to the press-forming direction, and which is configured to be inserted between the die slide and the die pad in a state where the die slide and the die pad are separated from each other, and the thickness of the base end portion may be thicker than the thickness of the tip end portion.

(3) In the press-forming apparatus in the above (1) or (2), the press-formed article may have a flange portion which connects a bending portion formed on an edge of at least one of the first sidewall portion and the second sidewall portion.

(4) The press-forming apparatus in the above (3) may include a flange forming tool arranged between the die and the punch; and a flange forming tool driving unit configured to move the flange forming tool between a position where a stroke range of the first divisional die or the second divisional die is interfered, and a position where a stroke range of the first divisional die or the second divisional die is not interfered, wherein an upper face of the flange forming tool and a lower face of at least one of the first divisional die and the second divisional die may have a shape corresponding to a face shape of the bending portion and the flange portion.

(5) In the press-forming apparatus in the above (4), the flange forming tool driving unit may be configured to move the flange forming tool into the direction perpendicular to the press-forming direction.

(6) In the press-forming apparatus in the above (4) or (5), a lower face of the flange forming tool may be in surface-contact with a ground face of the punch.

(7) The press-forming apparatus in any one of the above (1) to (6) may include a punch pad configured to be housed in a recessed portion formed in a top face of the punch, and a punch pad driving unit configured to move the punch pad in the press-forming direction.

(8) In the press-forming apparatus in any one of the above (1) to (7), the first divisional die may be formed integrally with the die slide.

(9) In the press-forming apparatus in any one of the above (1) to (8), the die slide may be connected to a single driving shaft.

(10) In the press-forming apparatus in any one of the above (1) to (9), the workpiece sheet may be a steel sheet.

(11) In the press-forming apparatus in any one of the above (1) to (10), a tensile strength of the workpiece sheet may be not less than 980 MPa.

(12) In the press-forming apparatus in any one of the above (1) to (11), the total length of the workpiece sheet may be more than 1700 mm.

(13) A second aspect of the present invention is a press-forming method for manufacturing the press-formed article by using the press-forming apparatus according to any one of the above (1) to (12), the press-forming method including; forming the first sidewall portion by moving the die slide toward the punch in a state where the insert block is not inserted between the die slide and the second divisional die; and forming the second sidewall portion by moving the die slide toward the punch in a state where the insert block is inserted between the die slide and the second divisional die.

(14) In the press-forming method according to the above (13), after performing the forming of the first sidewall portion, the insert block may be inserted between the die slide and the second divisional die, and the forming of the second sidewall portion may be performed.

(15) In the press-forming method according to the above (14), in the forming of the first sidewall portion, a portion in the workpiece sheet corresponding to the second sidewall portion may be pre-formed by using the second divisional die.

(16) In the press-forming method according to the above (13), after performing the forming of the second sidewall portion, the insert block may be pulled out from between the die slide and the second divisional die, and the forming of the first sidewall portion may be performed.

(17) In the press-forming method according to the above (16), in the forming of the second sidewall portion, a portion in the workpiece sheet corresponding to the first sidewall portion may be pre-formed by using the first divisional die.

(18) In the press-forming method according to any one of the above (13) to (17), before performing the forming of the first sidewall portion and the forming of the second sidewall portion, the die slide may be relatively moved toward the punch in a state where a flange forming tool is arranged at a position interfering with a stroke range of the first divisional die and the second divisional die, thereby forming a flange portion in the workpiece sheet by using the flange forming tool and at least one of the first divisional die and the second divisional die.

(19) In the press-forming method according to any one of the above (13) to (18), in at least one of the forming of the first sidewall portion and the forming of the second sidewall portion, the die slide may be lowered in a state where a punch pad configured to be housed in a recess portion formed in a top face of the punch is positioned high above a top face of the punch, and the punch pad may be lowered in accordance with the lowering of the die slide to complete a press-forming.

Effects of the Invention

According to the above aspects of the present invention, it is possible to manufacture a high strength and/or long size press-formed article while suppressing the excessive amount of the maximum press-forming load and the excessive size of the press-forming apparatus in the press-forming direction.

EMBODIMENTS OF THE INVENTION

The inventors obtained following new and important findings (A) to (C), as a result of earnest investigations to achieve the above objective.

(A) It is possible to significantly reduce a maximum press-forming load by performing press-forming of one sidewall portion and thereafter performing press-forming of the other sidewall portion, unlike the invention disclosed in Patent Document 1 which performs press-forming of left and right sidewall portions at the same time. This makes it possible to employ a conventional 1200 tons class press-forming apparatus for press-forming a blank having a tensile strength of not less than 1180 MPa and a length of more than 1700 mm. In addition, by press-forming one sidewall portion and pre-forming the other sidewall portion simultaneously, and thereafter press-forming the other sidewall which is pre-formed, it is possible to reduce the maximum press-forming load and suppress the generation of spring back so as to improve the dimensional accuracy.

(B) It is possible to prevent the height of the press-forming apparatus from increasing, by moving a blank holder toward a horizontal direction after forming the flange, unlike the invention disclosed in Patent Document 1 which moves the blank holder toward the lower direction after forming the flange.

(C) It is possible to practically overcome the generation of spring back in the press-formed article, by providing a punch pad which is movable to be in-out, positioning the blank above the upper face of the punch by the punch pad when the press-forming of the one sidewall portion is started and when the press-forming of the other sidewall portion is started, lowering the punch pad in accordance with the proceeding of the press fording of the one sidewall portion and the other sidewall portion, and housing the punch pad in the punch at the press-forming bottom dead point.

The present invention on the basis of the above findings (A) to (C) will be explained with reference to the attached drawings.

First Embodiment

Hereinafter, a press-forming apparatus 1 according to a first embodiment of the present invention will be explained in detail with reference to FIG. 1 and FIG. 2A to FIG. 2D.

Figure 1:
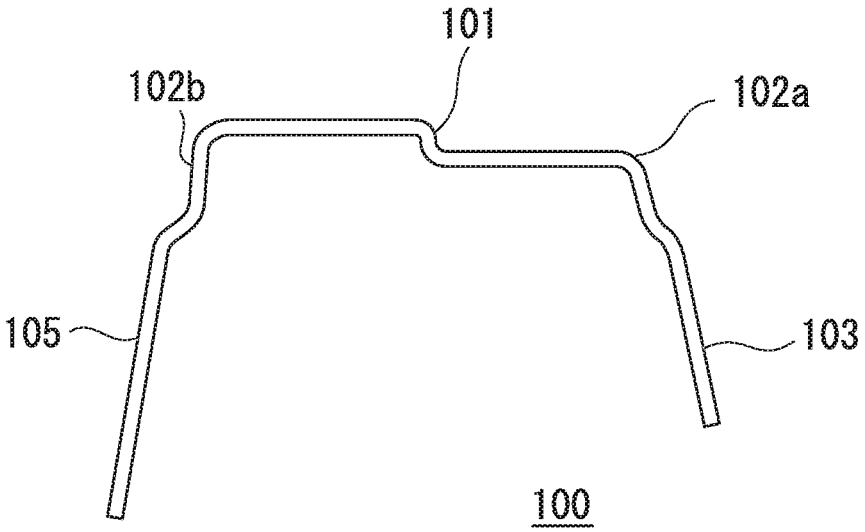
FIG. 1 is a cross sectional view of a press-formed article having a substantially U shaped cross-section.

FIG. 1 is a cross sectional view of a press-formed article 100 having a substantially U shaped cross-section. This cross sectional view is taken along a plane which is perpendicular to the longitudinal direction of the press-formed article. As shown in FIG. 2A to FIG. 2D, the press-forming apparatus 1 according to this embodiment relatively moves a die 10 and a punch 20 in the press-forming direction, thereby manufacturing the press-formed article 100 from a steel sheet S.

(Steel Sheet S)

The steel sheet S which is a workpiece sheet may be a sheet, for example having a tensile strength of not less than 980 MPa, a length in the longitudinal direction of more than 1700 mm, and a thickness of 0.8 to 2.3 mm. In this embodiment, as the steel sheet S, a flat sheet with no particular shape, but a sheet may be pre-formed with a particular shape.

(Press-Formed Article 100)

The press-formed article 100 includes a substantially U shaped cross-section as shown in FIG. 1, and has a top portion 101, a first sidewall portion 103 and a second sidewall portion 105 which connect to ridge portions 102*a*, 102*b* which are formed at both ends of the top portion 101. As shown in FIG. 1, the top portion 101, the first sidewall portion 103, and the second sidewall portion 105 may be formed with a particular surface shape.

(Punch 20)

The punch 20 is provided to face the die 10 in the press-forming direction, and has a first side face 20*a* which is formed with a shape corresponding to the first sidewall portion 103, a second side face 20*b* which is a face opposite to the first side face 20*a* and which is formed with a shape corresponding to the second sidewall portion 105, and a top face 20*c* which faces the die 10.

(Die)

The die 10 includes a die slide 11, a first divisional die 13, a second divisional die 15, a second divisional die driving unit 15D, a die pad 17, a die pad driving unit 17D, an insert block 19, and an insert block driving unit 19D. Hereinafter each of the components will be explained.

(Die Slide 11)

Figure 2A:
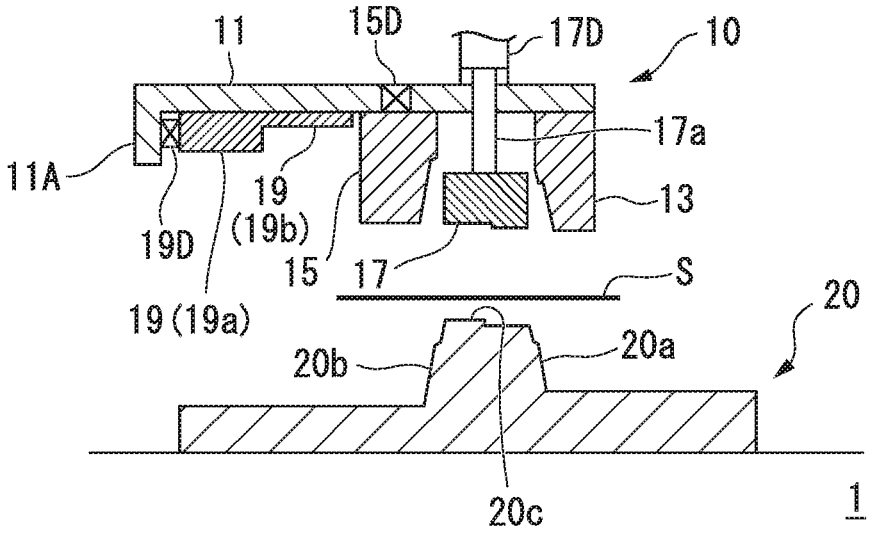
FIG. 2A is a view showing a press-forming method using a press-forming apparatus according to a first embodiment of the present invention, indicating a state before starting a press-forming.

As shown in FIG. 2A, the die slide 11 has a below surface at which a first divisional die 13 and a second divisional die 15 are provided, and the die slide 11 is connected to a single driving shaft or a plurality of driving shafts, which are not shown, so as to be movable in the vertical direction. The die slide 11 may be formed with a recessed portion for housing a second divisional die driving unit 15D for adjusting a separation distance from the second divisional die 15 in the vertical direction. The die slide 11 is formed with a suspending portion 11A to which an end portion of the insert block driving unit 19D, which will be explained later, is fixed.

(First Divisional Die 13)

The first divisional die 13 is provided to the die slide 11 so as to be adjacent to a first side face 20*a* of the punch 20 in a state where the die 10 and the punch 20 are closest to each other. In the example shown in FIG. 2A to FIG. 2D, the first divisional die 13 and the die slide 11 are drawn as separate members, but the first divisional die 13 and the die slide 11 may be formed integrally.

(Second Divisional Die 15)

The second divisional die 15 is provided to the die slide 11 so as to be adjacent to a second side face 20*b* of the punch 20 in a state where the die 10 and the punch 20 are closest to each other.

(Second Divisional Die Driving Unit 15D)

The second divisional die driving unit 15D is provided between the die slide 11 and the second divisional die 15, and is connected to a control unit not shown so as to drive the second divisional die 15, for approaching or separating the second divisional die 15 with respect to the die slide 15. More specifically, the second die driving unit 15D may be a pressing mechanism or an electrical motor that generates a gas pressure, an oil pressure, an air pressure, spring pressure, or the like.

(Die Pad 17)

The die pad 17 is provided between the first divisional die 13 and the second divisional die 15, and has a lower face having a shape corresponding to the top portion 101 and an upper face to which a lower end portion of a shaft 17*a* extending in the vertical direction is connected. The steel sheet S is press-formed in a state of being pressed by the die pad 17. It should be noted that in the example of this embodiment, the shaft 17*a* is formed so as to penetrate the die slide 11, and the upper end portion of the shaft 17*a* is connected to the die pad driving unit 17D.

(Die Pad Driving Unit 17D)

The die pad driving unit 17D is provided in or on the die slide 11, and is connected to a control unit not shown, so as to drive the die pad 17 in the press-forming direction such that the steel sheet S is clamped by the punch 20 and the die pad 17 at least during press-forming.

More specifically, the die pad driving unit 17D may be a pressing mechanism or an electrical motor that generates a gas pressure, an oil pressure, an air pressure, spring pressure, or the like.

(Insert Block 19)

The insert block 19 has a base end portion 19*a* and a tip end portion 19*b*. The base end portion 19*a* is configured to be inserted between the die slide 11 and the second divisional die 15, in a state where the die slide 11 and the second divisional die 15 are separated from each other. The tip end portion 19*b* extends from the base end portion 19*a* to a direction perpendicular to the press-forming direction (right direction in the drawing), and is configured to be inserted between the die slide 11 and the die pad 17 in a state where the die slide 11 and the die pad 17 are separated from each other. The height (thickness) of the base end portion 19*a* is larger than the height (thickness) of the tip end portion 19*b*.

Figure 2B:
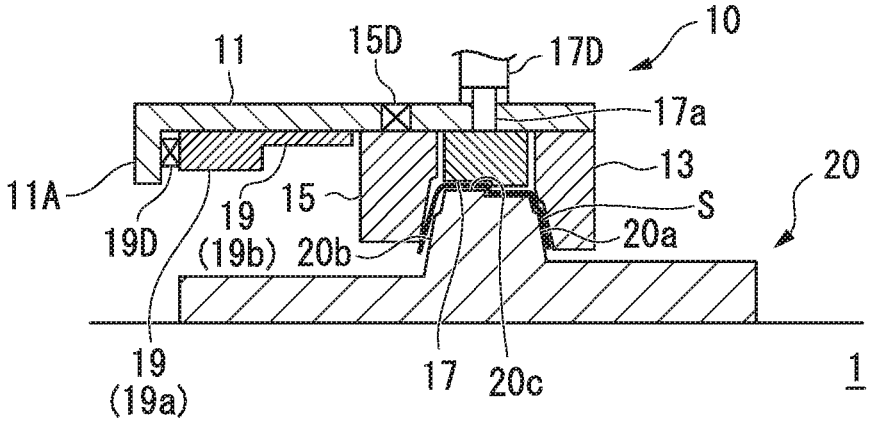
FIG. 2B is a view showing a press-forming method using a press-forming apparatus according to a first embodiment of the present invention, indicating a state where a first divisional die forms a first sidewall portion and a second divisional die pre-forms a second sidewall portion.
Figure 2C:
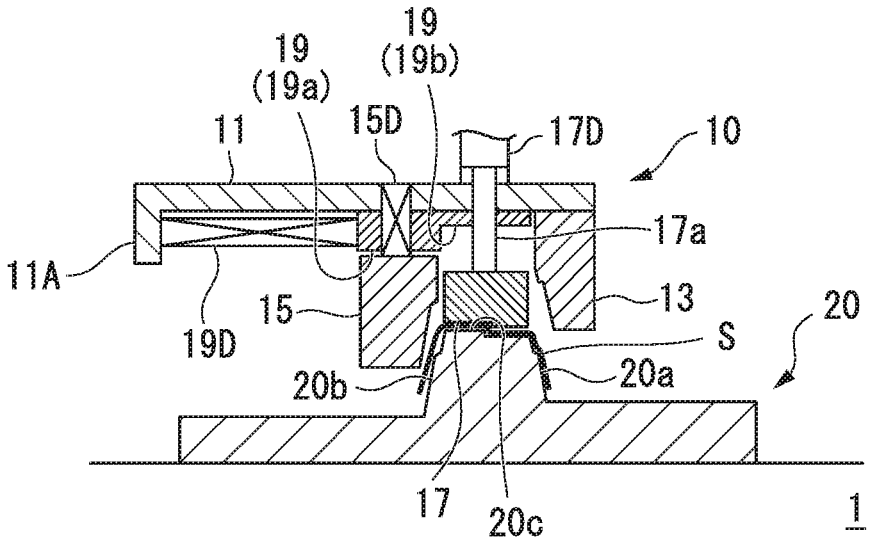
FIG. 2C is a view showing a press-forming method using a press-forming apparatus according to a first embodiment of the present invention, indicating a state where an insert block is inserted between a die slide and both of a second divisional die and a die pad.
Figure 2D:
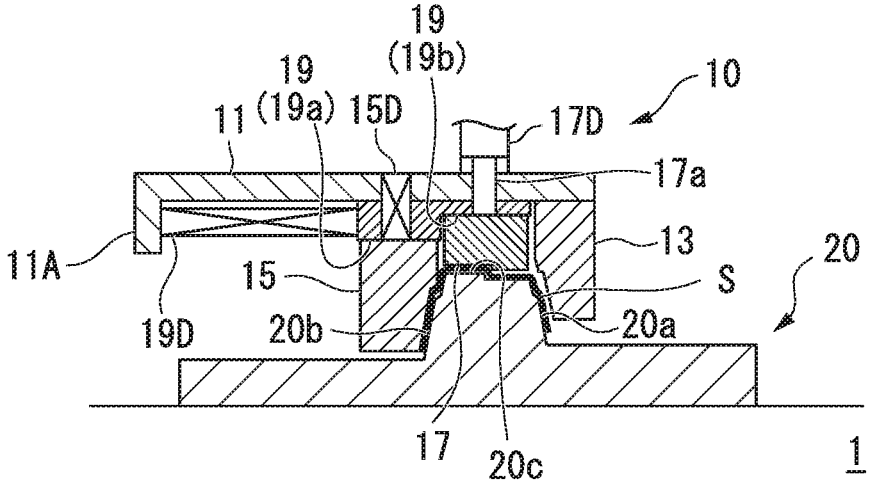
FIG. 2D is a view showing a press-forming method using a press-forming apparatus according to a first embodiment of the present invention, indicating a state where a second divisional die forms a second sidewall portion.

Accordingly, as shown in FIG. 2D, in a state where the insert block 19 is inserted, the base end portion 19*a* can adjust the gap in the height between the die slide 11 and the second divisional die 15 by the height (thickness) of the base end portion 19*a*. In addition, the tip end portion 19*b* can adjust the gap in the height between the die slide 11 and the die pad 17 by the height (thickness) of the tip end portion 19*b*.

Accordingly, it is possible to perform a press-forming by means of the first divisional die 13 and a press-forming by means of the second divisional die 15 at different timing. Further, it is possible to clamp the top portion by the punch 20 and the die pad 17 in both of the press-forming by means of the first divisional die 13 and the press-forming by means of the second divisional die 15.

(Insert Block Driving Unit 19D)

The insert block driving unit 19D has one end which is fixed to the suspending portion 11A of the die slide 11, and the other end which is fixed to the side face of the base end portion 19*a* of the insert block 19. The insert block driving unit 19D is connected to a controlling unit not shown, and moves the insert block 19 in the horizontal direction so as to insert the insert block 19 between the die slide 11 and the second divisional die 15 and between the die slide 11 and the die pad 17, or pull out the insert block 19 therefrom in the horizontal direction. More specifically, the insert block driving unit 19D may be a pressing mechanism or an electrical motor that generates a gas pressure, an oil pressure, an air pressure, spring pressure, or the like.

(Press-Forming Method)

An example of the press-forming method using the press-forming apparatus 1 according to this embodiment will be explained with reference to FIG. 2A to FIG. 2D.

First, as shown in FIG. 2A, the steel sheet S is placed on the punch 20.

Next, as shown in FIG. 2B, the die slide 11 is lowered so as to form the first sidewall portion 103 by the first divisional die 13 and the first side face 20*a* of the punch 20. At this timing, the second divisional die 15 and the punch 20 are separated from each other in the vertical direction, and therefore, the second sidewall portion 105 is not formed. However, it is preferable that the second sidewall portion 105 be pre-formed by the lowering of the second divisional die 15. In this case, the spring back of the second sidewall portion 105 can be suppressed, thus, the dimensional accuracy of the press-formed article 100 can be increased.

Next, as shown in FIG. 2C, the die slide 11 is rose and a gap is formed between the die slide 11 and both of the second divisional die 15 and the die pad 17. Then, the insert block 19 is inserted into this gap, thereby positioning the base end portion 19*a* of the insert block 19 between the die slide 11 and the second divisional die 15, and positioning the tip end portion 19*b* of the insert block 19 between the die slide 11 and the die pad 17.

Next, as shown in FIG. 2D, the press-formed article 100 is obtained by lowering the die slide 11 to form the second sidewall portion 105 in a state where the insert block 19 is inserted.

It should be noted that, in the above example, the first sidewall portion 103 is firstly formed and thereafter the second sidewall portion 105 is formed, however, it may be possible that the second sidewall portion 105 is firstly formed and thereafter the first sidewall portion 103 is formed. In this case, the second sidewall portion 105 is formed and if necessary, the first sidewall portion 103 is pre-formed in a state where the insert block 19 is inserted, and thereafter, the first sidewall portion 103 is formed in a state where the insert block 19 is pulled out in the horizontal direction.

By means of the press-forming apparatus 1 according to the this embodiment, because the insert block 19 movable in the horizontal direction is used, it is possible to press-form the first sidewall portion 103 and the second sidewall portion 105 at a different timing, without increasing the size in the height direction of the press-forming apparatus 1. In addition, the top portion 101 can be clamped by the die pad 17 and the punch 20 at a time of press-forming the first sidewall portion 103 and at a time of press-forming the second sidewall portion 105, therefore, the dimensional accuracy of the press-formed article 100 can be improved. Accordingly, for example, by using a conventional 1200 tons class press-forming apparatus, it is possible to obtain a press-formed article 100 having a substantially U shaped cross-section with high dimensional accuracy from a blank with a tensile strength of not less than 980 MPa and a length of longer than 1700 mm.

Second Embodiment

Hereinafter, a press-forming apparatus 1' according to a second embodiment of the present invention will be explained with reference to FIG. 3 and FIG. 4A to FIG. 4F. To simplify the explanation, members used in the press-forming apparatus 1 according to the first embodiment are applied with the same reference numeral, and the same explanation is omitted.

Figure 3:
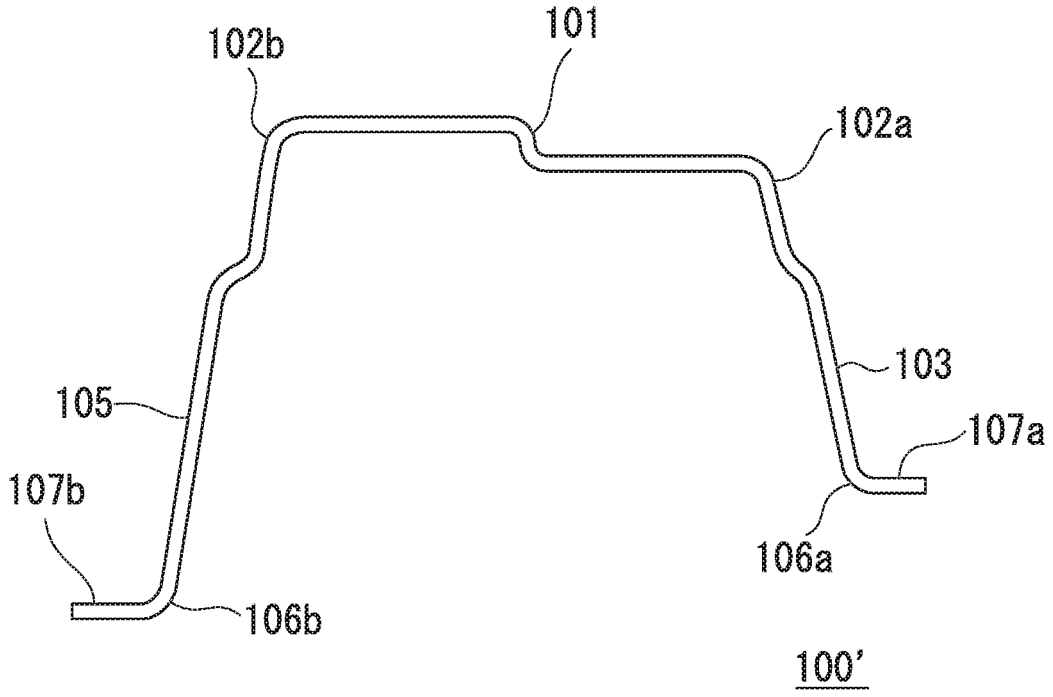
FIG. 3 is a cross sectional view of a press-formed article having a hat type cross-section.

FIG. 3 shows a cross sectional view of a press-formed article 100' having a hat type cross-section obtained by this embodiment, which is taken along a plane perpendicular to the longitudinal direction. As shown in FIG. 4A to FIG. 4F, the press-forming apparatus 1' according to this embodiment manufacture the press-formed article 100' from a steel sheet S by relatively moving the die 10 and the punch 20' in the press-forming direction.

(Steel Sheet S)

The steel sheet S, as a workpiece sheet, may be for example a sheet having a tensile strength of not less than 980 MPa, a length longer than 1700 mm in the longitudinal direction, and a thickness of 0.8 to 2.3 mm. In this embodiment, as the steel sheet S, a flat sheet with no particular shape, but a sheet may be pre-formed with a particular shape.

(Press-Formed Article 100')

The press-formed article 100' includes a substantially U shaped cross-section as shown in FIG. 3, and has a top portion 101, a first sidewall portion 103 and a second sidewall portion 105 which connect to ridge portions 102*a*, 102*b* which are formed at both ends of the top portion 101, and flange portions 107*a*, 107*b* which connect to bending portions 106*a*, 106*b* formed at the first sidewall portion 103 and the second sidewall portion 105.

(Punch 20')

The punch 20' is provided to face the die 10 in the vertical direction, and has a first side face 20*a* which is formed with a shape corresponding to the first sidewall portion 103, a second side face 20*b* which is a face opposite to the first side face 20*a* and which is formed with a shape corresponding to the second sidewall portion 105, and a top face 20*c* which faces the die 10.

Further, in this embodiment, the punch 20' has a ground face 20*d* which externally extends in the horizontal direction from the first side face 20*a* and the second side face 20*b*, and a lateral wall portion 20A which extends from the ground face 20*d* in the upper direction.

(Flange Forming Tools 30*a*, 30*b*)

The flange forming tools 30*a*, 30*b* are provided respectively on the punch 20' so as to be movable in the horizontal direction. The upper face of the flange forming tool is formed with a shape (recessed portion) corresponding to the bending portion 106*a*, 106*b* and the flange portion 107*a*, 107*b* of the press-formed article 100'. Then, in the same manner, a bottom end portion 13*a* of the first divisional die 13 and a bottom end portion 15*a* of the second divisional die 15 respectively have a shape corresponding to the bending portions 106*a*, 106*b*, and the flange portions 107*a*, 107*b*. The bending portions 106*a*, 106*b*, and the flange portions 107*a*, 107*b* are formed by pushing the bottom end portion 13*a* of the first divisional die 13 and the bottom end portion 15*a* of the second divisional die 15 into an upper face of the flange forming tool.

In the flange forming tools 30*a*, 30*b*, if a depth or a width of a recessed portion formed in an upper face with an inner shape corresponding to the bending portions 106*a*, 106*b*, and flange portions 107*a*, 107*b* of the press-formed article 100' to be manufactured is not within a proper range, the steel sheet S is warped at the time of forming the bending portions 106*a*, 106*b* and the flange portions 107*a*, 107*b*, whereby a large deviation of a stress distribution in the thickness direction is generated. This results in a generation of the residual stress, and thus, due to inferior shape taxability, a failure occurs in the bending portions 106*a*, 106*a* and the flange portions 107*a*, 107*b*.

Accordingly, it is preferable that the recessed portion formed in the upper face of the flange forming tool 30*a*, 30*b* have a depth not more than 10 mm, and a width not less than 10 mm, in order to properly form the bending portions 106*a*, 106*b*, and the flange portions 107*a*, 107*b*.

A side face of the flange forming tools 30*a*, 30*b*, which does not face a side face of the punch 20', is fixed with a flange forming tool driving unit 30D.

A lower face of the flange forming tool 30*a*, 30*b* may be in surface to surface contact with the ground face 20*d* of the punch.

The lower face of the flange forming tool 30*a*, 30*b*, and/or the upper face (ground face 20*d*) of the punch 20' may be provided with a member for reducing a frictional force, such as a linear guide member, wearing plate member, and a liner member.

(Flange Forming Tool Driving Unit 30D)

The flange forming tool driving unit 30D has one end which is fixed to the lateral wall portion 20A of the punch 20', and the other end which is fixed to the side face of the flange forming tool 30*a*, 30*b*, which does not face the side face of the punch 20'. The flange forming tool driving unit 30D is connected to a controlling unit not shown, and moves the flange forming tool 30*a*, 30*b* in the horizontal direction between a position interfering a stroke range of the first divisional die or the second divisional die, and a position not interfering the stroke range. More specifically, the flange forming tool driving unit 30D may be a pressing mechanism or an electrical motor that generates a gas pressure, an oil pressure, an air pressure, spring pressure, or the like.

(Press-Forming Method)

An example of the press-forming method using the press-forming apparatus 1' according to this embodiment will be explained with reference to FIG. 4A to FIG. 4D.

Figure 4A:
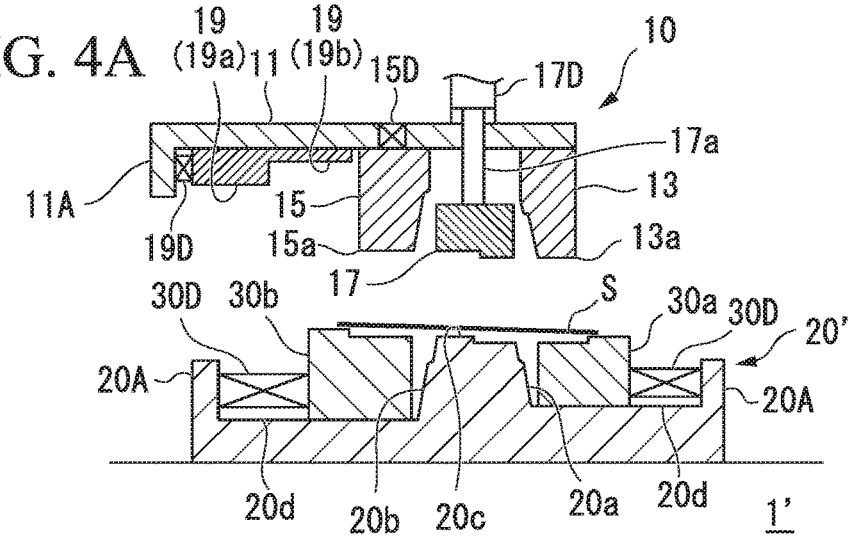
FIG. 4A is a view showing a press-forming method using a press-forming apparatus according to a second embodiment of the present invention, indicating a state before starting a press-forming.

First, as shown in FIG. 4A, the flange forming tools 30*a*, 30*b* are provided at a position interfering a stroke range of the first divisional die 13 and the second divisional die 15, and place the steel sheet S on the flange forming tools 30*a*, 30*b*.

Figure 4B:
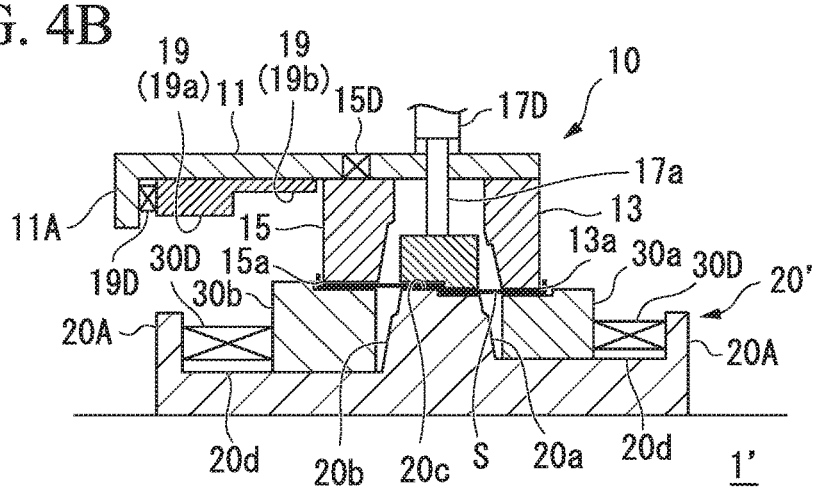
FIG. 4B is a view showing a press-forming method using a press-forming apparatus according to a second embodiment of the present invention, indicating a state where a flange forming tool, a first divisional die, and a second divisional die form a flange portion.

Next, as shown in FIG. 4B, by lowering the die slide 11, the bottom end portion 13*a* of the first divisional die 13 and the bottom end portion 15*a* of the second divisional die 15 are pushed into an upper face of the flange forming tools 30*a*, 30*b* formed with a shape corresponding to the bending portions 106*a*, 106*b* and the flange portions 107*a*, 107*b*, thereby forming the bending portions 106*a*, 106*b* and the flange portions 107*a*, 107*b*. If the top portion 101 does not have a planar shape, the top portion 101 may be simultaneously formed by pushing the die pad 17 into the top face 20*c* of the punch 20' at the time of forming the flange portions 107*a*, 107*b*.

Figure 4C:
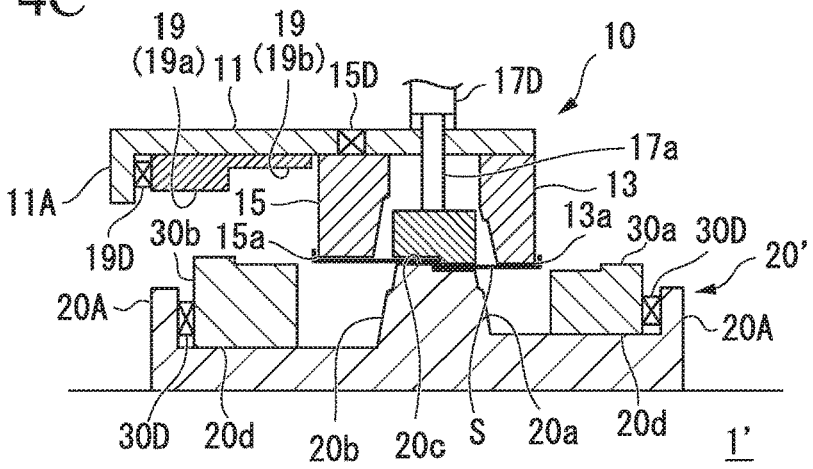
FIG. 4C is a view showing a press-forming method using a press-forming apparatus according to a second embodiment of the present invention, indicating a state where a flange forming tool is moved away in the horizontal direction.

Next, as shown in FIG. 4C, the flange forming tools 30*a*, 30*b* are moved in the horizontal direction so as to be located at a position not interfering the stroke range of the first divisional die 13 and the second divisional die 15.

Figure 4D:
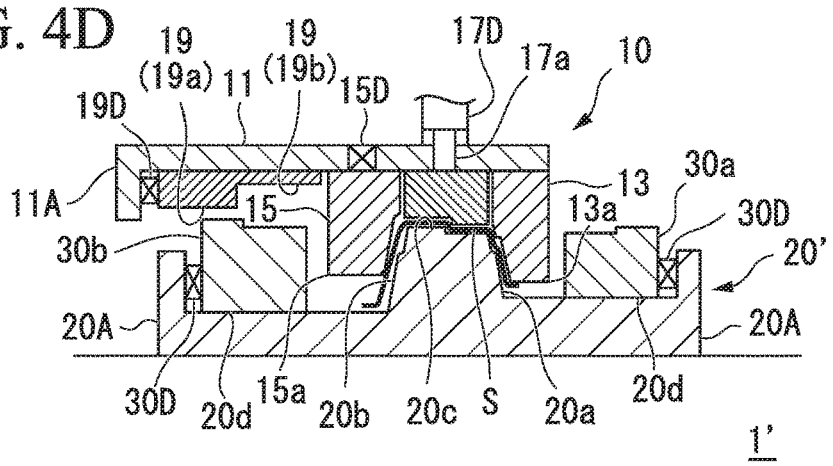
FIG. 4D is a view showing a press-forming method using a press-forming apparatus according to a second embodiment of the present invention, indicating a state where a first divisional die forms a first sidewall portion and a second divisional die pre-forms a second sidewall portion.

Next, as shown in FIG. 4D, the die slide 11 is lowered so as to form the first sidewall portion 103 by the first divisional die 13 and the first side face 20*a* of the punch 20'. At this timing, the second divisional die 15 and the punch 20' are separated from each other in the vertical direction, and therefore, the second sidewall portion 105 is not formed. However, it is preferable that the second sidewall portion 105 be pre-formed by the lowering of the second divisional die 15, as the spring back of the second sidewall portion 105 can be suppressed.

Figure 4E:
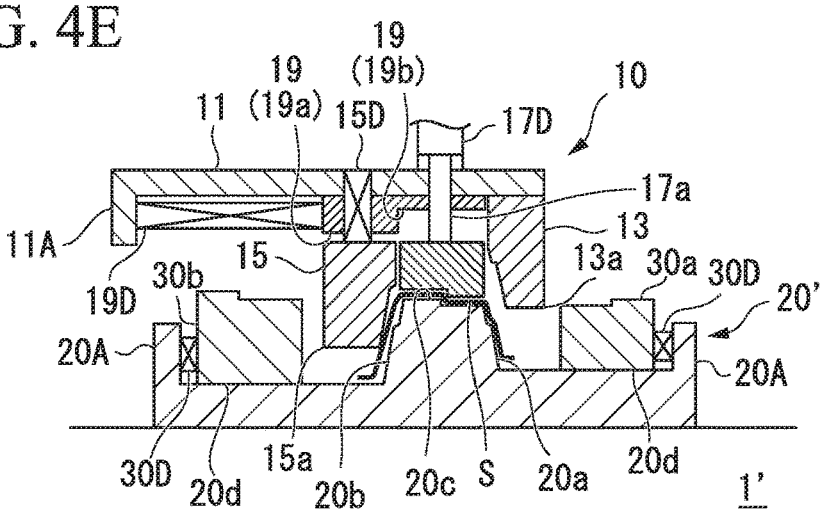
FIG. 4E is a view showing a press-forming method using a press-forming apparatus according to a second embodiment of the present invention, indicating a state where an insert block is inserted between a die slide and both of a second divisional die and a die pad.

Next, as shown in FIG. 4E, the die slide 11 is rose and a gap is formed between the die slide 11 and both of the second divisional die 15 and the die pad 17. Then, the insert block 19 is inserted into this gap, thereby positioning the base end portion 19*a* of the insert block 19 between the die slide 11 and the second divisional die 15, and positioning the tip end portion 19*b* of the insert block 19 between the die slide 11 and the die pad 17.

Figure 4F:
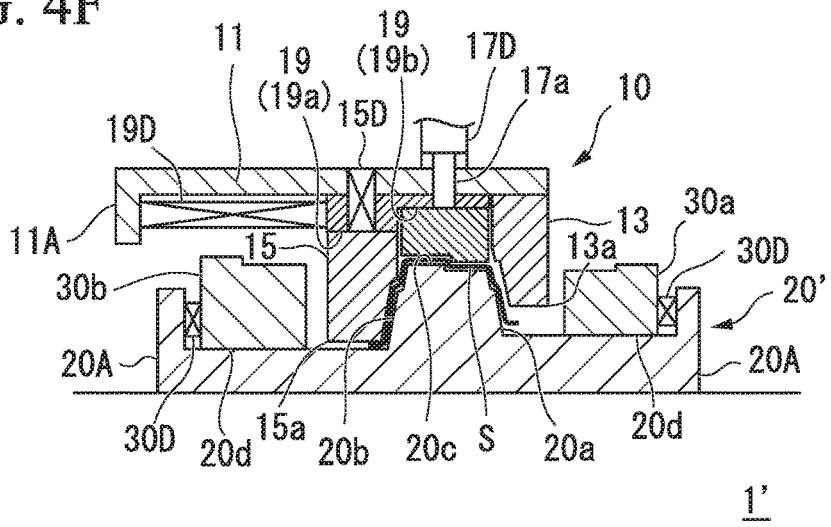
FIG. 4F is a view showing a press-forming method using a press-forming apparatus according to a second embodiment of the present invention, indicating a state where a second divisional die forms a second sidewall portion.

Next, as shown in FIG. 4F, the die slide 11 is lowered in a state where the insert block 19 is inserted, whereby the second sidewall 105 is formed by the second divisional die 15 and the second side face 20*b* of the punch 20'. The press-formed article 100' with a hat type cross-section is thus obtained.

It should be noted that, in the above example, the first sidewall portion 103 is firstly formed and thereafter the second sidewall portion 105 is formed, however, it may be possible that the second sidewall portion 105 is firstly formed and thereafter the first sidewall portion 103 is formed. In this case, the second sidewall portion 105 is formed and if necessary, the first sidewall portion 103 is pre-formed in a state where the insert block 19 is inserted, and thereafter, the first sidewall portion 103 is formed in a state where the insert block 19 is pulled out in the horizontal direction.

By means of the press-forming apparatus 1' according to the this embodiment, because the insert block 19 movable in the horizontal direction is used, it is possible to press form the first sidewall portion 103 and the second sidewall portion 105 at a different timing, without increasing the size in the height direction of the press-forming apparatus 1'. In addition, the top portion 101 can be clamped by the die pad 17 and the punch at a time of press-forming the first sidewall portion 103 and at a time of press-forming the second sidewall portion 105, therefore, the dimensional accuracy of the press-formed article 100 can be improved.

In addition, since the flange forming tools 30*a*, 30*b* movable in the horizontal direction are used, it is possible to manufacture the press-formed article 100' having hat type cross-section without increasing the size of the press-forming tool in the height direction, by one set of forming tool (that is, without separately preparing a first forming tool for forming the flange portions 107*a*, 107*b* and a second forming tool for forming the sidewall portions).

Accordingly, for example, by using a conventional 1200 tons class press-forming apparatus, it is possible to obtain a press-formed article 100' having a hat type cross-section with high dimensional accuracy from a blank with a tensile strength of not less than 980 MPa and a length of longer than 1700 mm.

Third Embodiment

An example of the press-forming apparatus 1" according to the third embodiment will be explained with reference to FIG. 5A to FIG. 5F.

To simplify the explanation, members used in the press-forming apparatus 1 according to the first embodiment and the press-forming apparatus 1' according to the second embodiment are applied with the same reference numeral, and the same explanation is omitted.

In this embodiment, the press-formed article 100' having a hat type cross-section as shown in FIG. 3 is press-formed.

That is, as shown in FIG. 5A to FIG. 5F, the press-forming apparatus 1" according to this embodiment manufactures a press-formed article 100' from the steel sheet S by relatively moving the die 10 and the punch 20" in the press-forming direction.

(Punch 20")

The punch 20" is provided to face the die 10 in the vertical direction, and has a first side face 20*a* which is formed with a shape corresponding to the first sidewall portion 103, a second side face 20*b* which is a face opposite to the first side face 20*a* and which is formed with a shape corresponding to the second sidewall portion 105, and a top face 20*c* which faces the die 10.

Further, in this embodiment, the punch 20" has a ground face 20*d* which externally extends in the horizontal direction from the first side face 20*a* and the second side face 20*b*, and a lateral wall portion 20A which extends from the ground face 20*d* in the upper direction. In addition, a recessed portion is formed in the top face 20*c* of the punch 20".

(Punch Pad 27)

A punch pad 27 is housed in the recessed portion formed in the top face 20*c* of the punch 20", and includes an upper face having a shape corresponding to the top portion 101 and a lower face to which an upper end portion of a shaft 27*a* extending in the vertical direction is connected. The steel sheet S is press-formed in a state of being clamped between the die pad 17 and the punch pad 27. The punch pad 27 is preferably configured such that, in a state of fully housed in the recessed portion in the top face 20*c* of the punch 20", the end edge portions of the upper face of the punch pad 27 and the top face 20*c* of the punch 20" are continued in a same plane. It should be noted that the shaft 27*a* is provided so as to penetrate the punch 20" and the lower end portion of the shaft 27*a* is connected to the punch pad driving unit 27D.

As the punch pad 27, for example, a mechanism disclosed in WO 2013/094705 may be used. By using this punch pad 27, at a time of starting a press-forming of the ridge portions 102*a*, 102*b*, the first sidewall portion 103, and a second sidewall portion 105 of the press-formed article 100', the steel sheet S is upwardly separated so as to be high above the top face 20*c* of the punch 20", it is possible to significantly suppress the generation of the spring back in the press-formed article 100'.

(Punch Pad Driving Unit 27D)

The punch pad driving unit 27D is provided at an inner portion or a lower portion of the punch 20", and is connected to a controlling unit not shown, so as to move the punch pad 27 to clamp the steel sheet S between the punch pad 27 and the die pad 17 at least when performing a press-forming.

More specifically, the punch pad driving unit 27D may be a pressing mechanism or an electrical motor that generates a gas pressure, an oil pressure, an air pressure, spring pressure, or the like.

(Press-Forming Method)

An example of the press-forming method using the press-forming apparatus 1" according to this embodiment will be explained with reference to FIG. 5A to FIG. 5F.

Figure 5A:
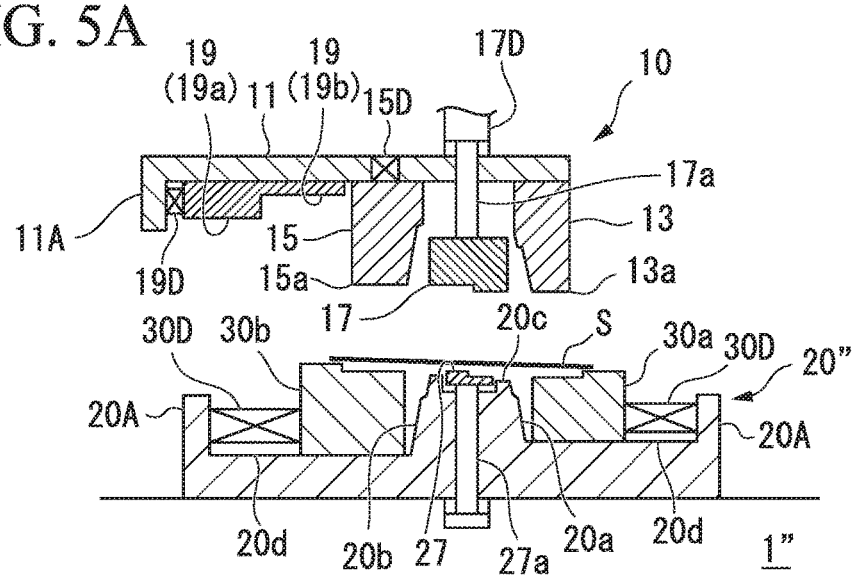
FIG. 5A is a view showing a press-forming method using a press-forming apparatus according to a third embodiment of the present invention, indicating a state before starting a press-forming.

First, as shown in FIG. 5A, the flange forming tools 30*a*, 30*b* are provided at a position interfering a stroke range of the first divisional die 13 and the second divisional die 15, and place the steel sheet S on the flange forming tools 30*a*, 30*b*. At this timing, the punch pad 27 is posed in a state of standing above from the top face 20*c* of the punch 20" so as to contact with the steel sheet S, whereby the steel sheet S is upwardly separated from the top face 20*c* of the punch 20".

Figure 5B:
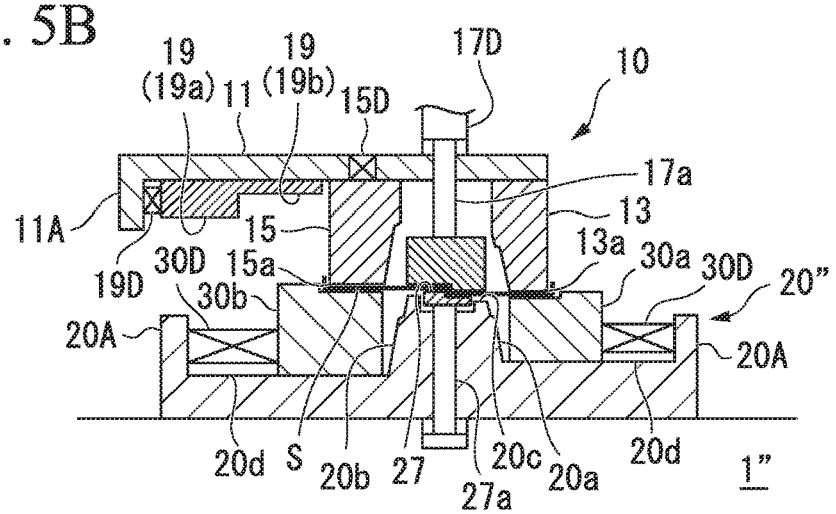
FIG. 5B is a view showing a press-forming method using a press-forming apparatus according to a third embodiment of the present invention, indicating a state where a flange forming tool, a first divisional die, and a second divisional die form a flange portion.

Next, as shown in FIG. 5B, by lowering the die slide 11, the bottom end portion 13*a* of the first divisional die 13 and the bottom end portion 15*a* of the second divisional die 15 are pushed into an upper face of the flange forming tools 30*a*, 30*b* formed with a shape corresponding to the bending portions 106*a*, 106*b* and the flange portions 107*a*, 107*b*, thereby forming the bending portions 106*a*, 106*b* and the flange portions 107*a*, 107*b*. If the top portion 101 does not have a planar shape, the top portion 101 may be formed by pushing the die pad 17 into the punch pad 27 at the time of forming the bending portions 106*a*, 106*b* and the flange portions 107*a*, 107*b*.

Figure 5C:
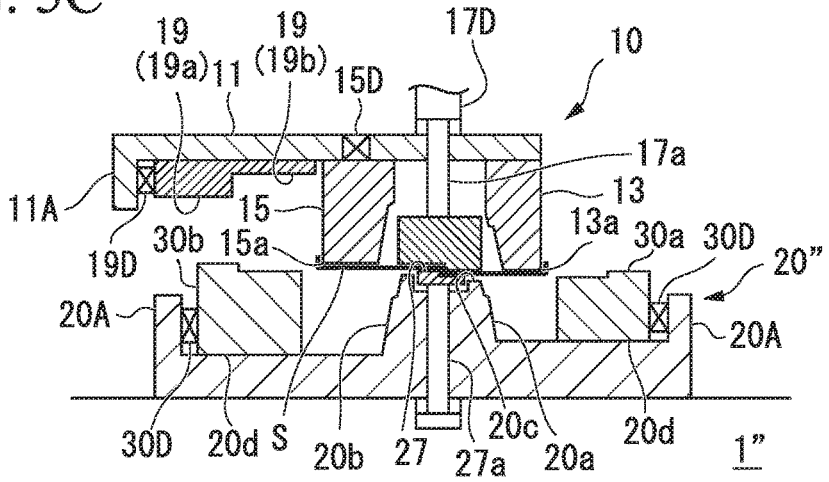
FIG. 5C is a view showing a press-forming method using a press-forming apparatus according to a third embodiment of the present invention, indicating a state where a flange forming tool is moved away in the horizontal direction.

Next, as shown in FIG. 5C, the flange forming tools 30*a*, 30*b* are moved in the horizontal direction so as to be located at a position not interfering the stroke range of the first divisional die 13 and the second divisional die.

Figure 5D:
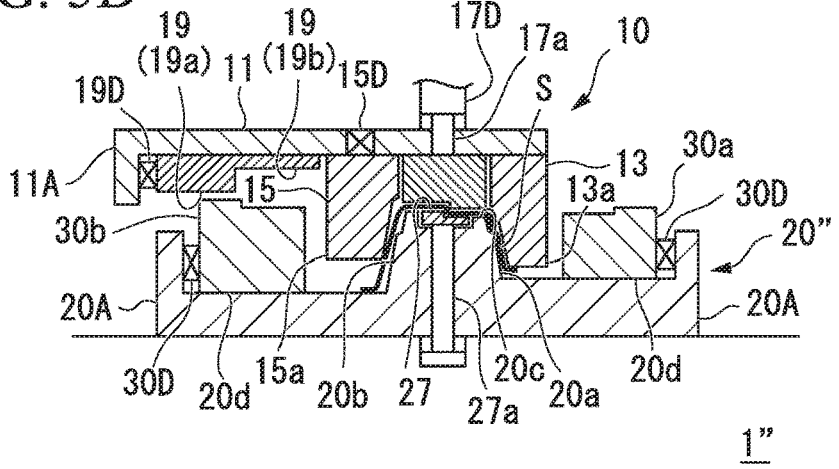
FIG. 5D is a view showing a press-forming method using a press-forming apparatus according to a third embodiment of the present invention, indicating a state where a first divisional die forms a first sidewall portion and a second divisional die pre-forms a second sidewall portion.

Next, as shown in FIG. 5D, the die slide 11 is lowered so as to form the first sidewall portion 103 by the first divisional die 13 and the first side face 20*a* of the punch 20". At this timing, the second divisional die 15 and the punch 20" are separated from each other in the vertical direction, and therefore, the second sidewall portion 105 is not formed. However, it is preferable that the second sidewall portion 105 be pre-formed by the lowering of the second divisional die 15, as the spring back of the second sidewall portion 105 can be suppressed.

It should be noted that the movement in the vertical direction of the punch pad 27 is controlled such that a timing completing the pushing of the first divisional die 13 and a timing fully housing the punch pad 27 in the recessed portion of the punch 20" are the same. That is, at the time when the press-formed article 100' is press-formed, the punch pad 27 is pressed toward the punch 20" gradually in the lower direction by being pushed by the die pad 17, being housed in the recessed portion of the punch 20" at the press-forming bottom dead point so as to have a co-plane with the top face 20*c* of the punch 20". By controlling the movement of the punch pad 27 in the vertical direction in this manner, the generation of the spring back can be suppressed to improve the dimensional accuracy.

Figure 5E:
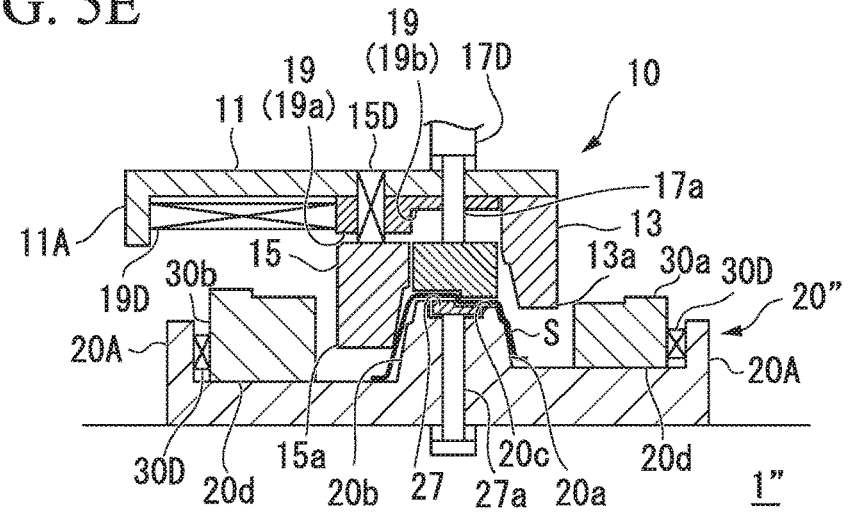
FIG. 5E is a view showing a press-forming method using a press-forming apparatus according to a third embodiment of the present invention, indicating a state where an insert block is inserted between a die slide and both of a second divisional die and a die pad.

Next, as shown in FIG. 5E, the die slide 11 is rose and a gap is formed between the die slide 11 and both of the second divisional die 15 and the die pad 17. Then, the insert block 19 is inserted into this gap, thereby positioning the base end portion 19*a* of the insert block 19 between the die slide 11 and the second divisional die 15, and positioning the tip end portion 19*b* of the insert block 19 between the die slide 11 and the die pad 17.

Figure 5F:
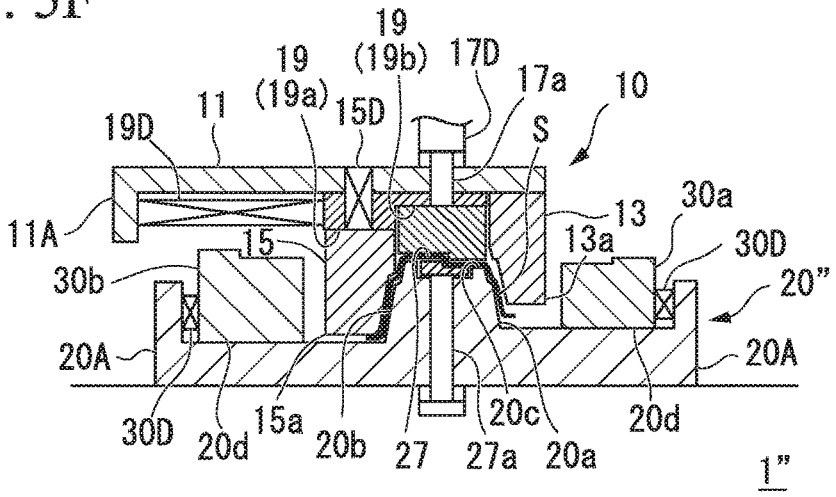
FIG. 5F is a view showing a press-forming method using a press-forming apparatus according to a third embodiment of the present invention, indicating a state where a second divisional die forms a second sidewall portion.

Next, as shown in FIG. 5F, the die slide 11 is lowered in a state where the insert block 19 is inserted, whereby the second sidewall 105 is formed by the second divisional die 15 and the second side face 20*b* of the punch 20". The press-formed article 100' with a hat type cross-section is thus obtained.

Here as well, the raising and lowering movements of the punch pad 27 is controlled such that a timing completing the pushing of the second divisional die 15 and a timing fully housing the punch pad 27 in the recessed portion of the punch are the same. By controlling the movement in the vertical direction of the punch pad 27 in this manner, it is possible to suppress the generation of the spring back to improve the dimensional accuracy.

It should be noted that, in the above example, the first sidewall portion 103 is firstly formed and thereafter the second sidewall portion 105 is formed, however, it may be possible that the second sidewall portion 105 is firstly formed and thereafter the first sidewall portion 103 is formed. In this case, the second sidewall portion 105 is formed and if necessary, the first sidewall portion 103 is pre-formed in a state where the insert block 19 is inserted, and thereafter, the first sidewall portion 103 is formed in a state where the insert block 19 is pulled out in the horizontal direction.

By means of the press-forming apparatus 1' according to the this embodiment, because the insert block 19 movable in the horizontal direction is used, it is possible to press-form the first sidewall portion 103 and the second sidewall portion 105 at a different timing, without increasing the size in the height direction of the press-forming apparatus 1'. In addition, the top portion 101 can be clamped by the die pad 17 and the punch 20" at a time of press-forming the first sidewall portion 103 and at a time of press-forming the second sidewall portion 105, therefore, the dimensional accuracy of the press-formed article 100 can be improved.

In addition, since the flange forming tools 30*a*, 30*b* movable in the horizontal direction are used, it is possible to manufacture the press-formed article 100' having hat type cross-section without increasing the size of the press-forming tool in the height direction, by one set of forming tool (that is, without separately preparing a first forming tool for forming the flange portions 107*a*, 107*b* and a second forming tool for forming the sidewall portions).

Further, at the time of forming the sidewall portion, the punch pad 27 is controlled in the vertical direction, therefore, the spring back in the sidewall portion can be suppressed. This makes it possible to improve the dimensional accuracy.

Accordingly, for example, by using a conventional 1200 tons class press-forming apparatus, it is possible to obtain a press-formed article 100' having a hat type cross-section with high dimensional accuracy from a blank with a tensile strength of not less than 980 MPa and a length of longer than 1700 mm.

Figure 6:
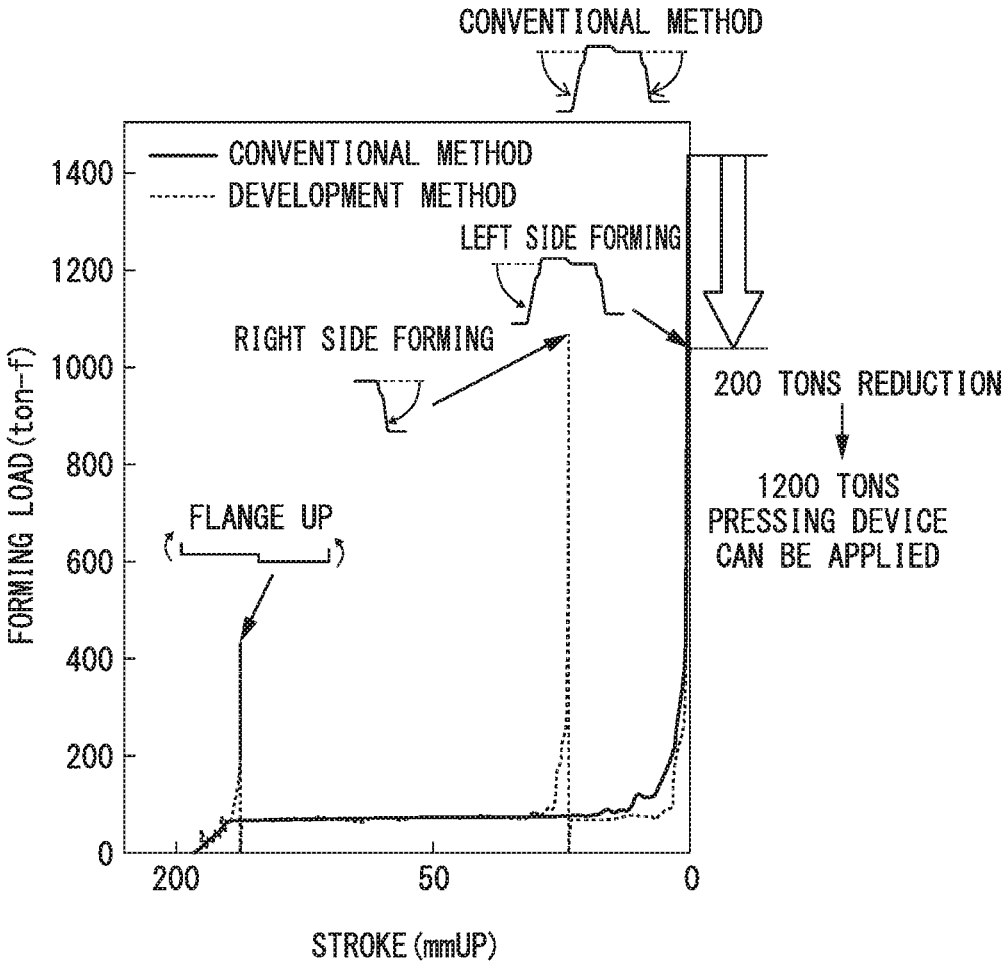
FIG. 6 is a graph showing an example of a relationship between a press-forming stroke and a press-forming load in a case where a press-formed article having a hat type cross-section is manufactured by using a press-forming apparatus according to a third embodiment of the present invention.

FIG. 6 is a graph showing a relationship between a stroke and a forming load in a case of manufacturing, by using a press-forming apparatus 1" of FIG. 5A to FIG. 5F, a press-formed article 100' having a hat type cross-section from a steel sheet (thickness of 1.2 mm). The steel sheet has a tensile strength of not less than 980 MPa, and a total length of longer than 1700 mm. In the press-formed article 100', the width of the top portion 101 is 100 mm, the radius of curvature of the ridge portions 102*a*, 102*b* is 5.5 mm, the height of the first sidewall portion 103 is 60 mm, the height of the second sidewall portion 105 is 90 mm, the radius of curvature of the bending portions 106*a*, 106*b* is 5.5 mm, and the width of the flange portions 107*am* 107*b* is 20 mm.

The "stroke" indicated in the graph of FIG. 6 means a raising and lowering stroke of the first divisional die 13 and the second divisional die 15, and the "forming load" means the load applied to the die slide 11. Further, the "developed method" indicated in the graph of FIG. 7 means a case of forming by the present invention, and the "conventional method" means a case of forming by a pad-bending method.

As shown in FIG. 6, according to the forming method by the press-forming apparatus 1" of the third embodiment (development method), it can be confirmed that the forming load can be reduced by 200 tons compared to the conventional method, and thus, the press-formed article 100' having a hat type cross-section such as a side sill inner panel or a side sill outer panel, with high strength and long size having a tensile strength of not less than 980 MPa (preferably not less than 1180 MPa) and a total length of longer than 1700 mm (preferably longer than 2000 mm) can be manufactured by one set press-forming tool by using a 1200 tons class press-machine.

Figure 7:
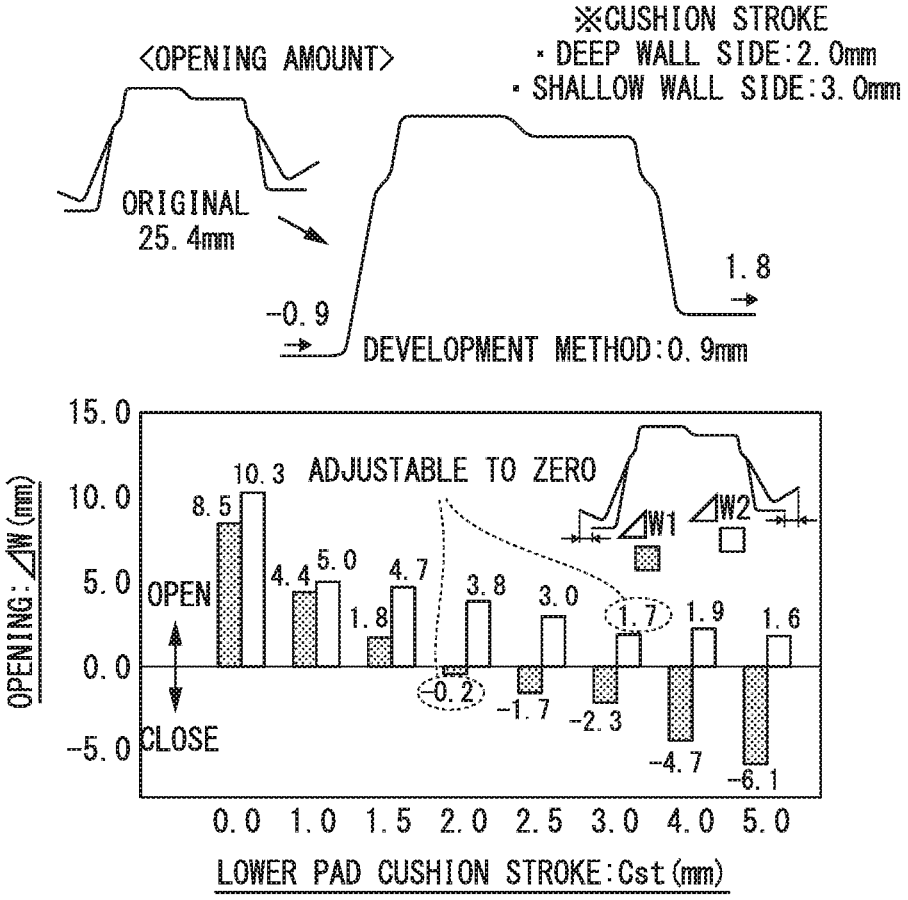
FIG. 7 is a graph showing an example of a relationship between a stroke of a punch pad and a spring back amount.
Figure 8A:
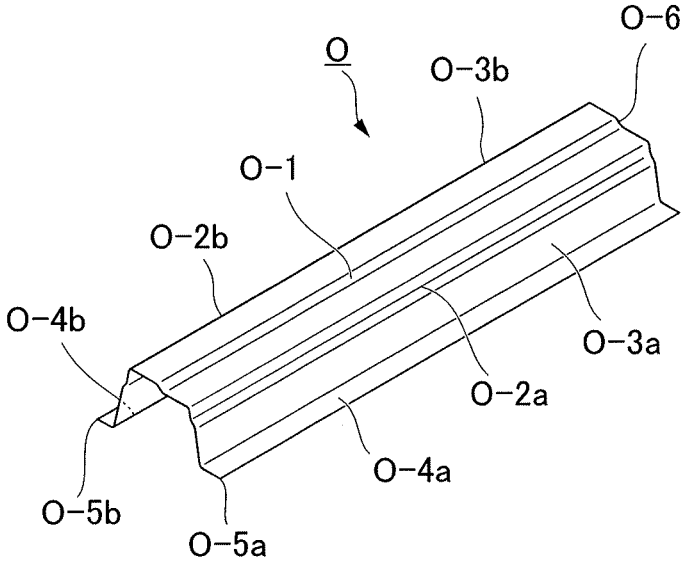
FIG. 8A PRIOR ART
FIG. 8A is a perspective view of a side sill inner panel.
Figure 8B:
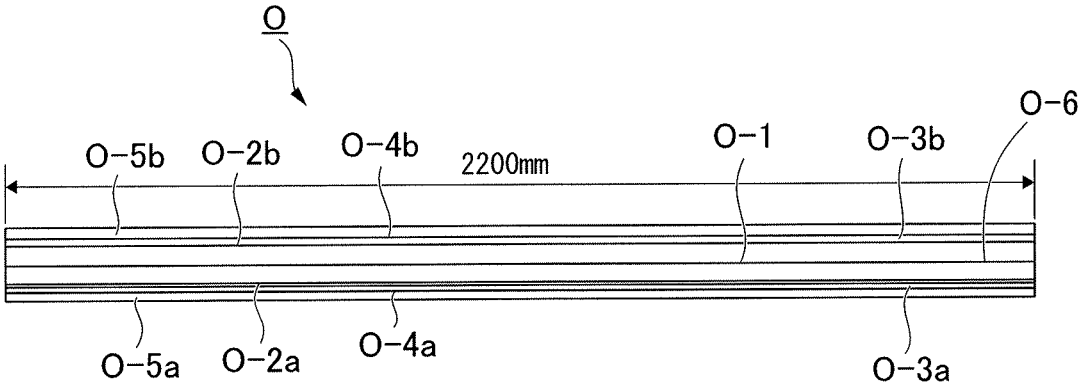
FIG. 8B PRIOR ART
FIG. 8B is a plan view of a side sill inner panel.
Figure 9A:
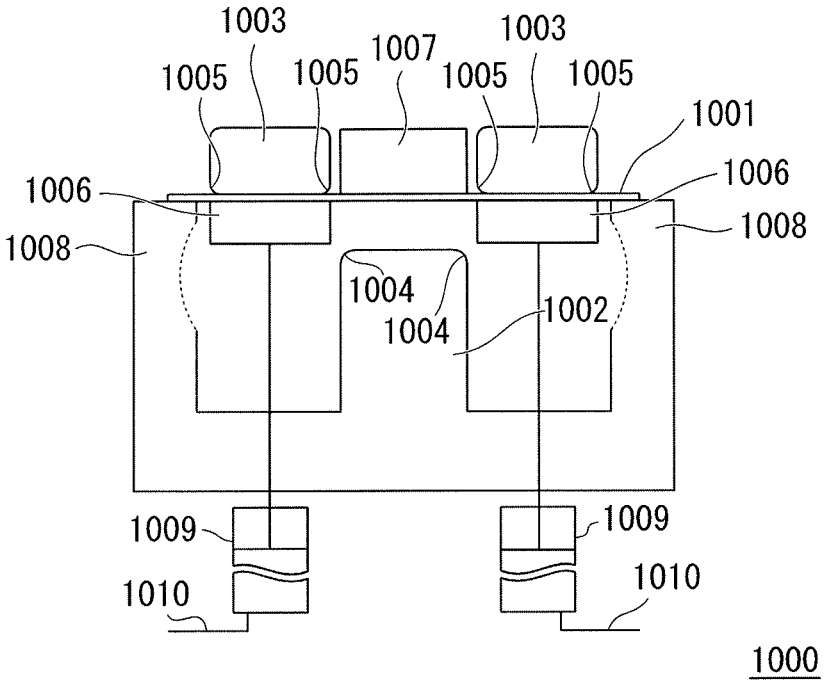
FIG. 9A PRIOR ART
FIG. 9A shows a first step of a press-forming method disclosed in the Patent Document 1.
Figure 9B:
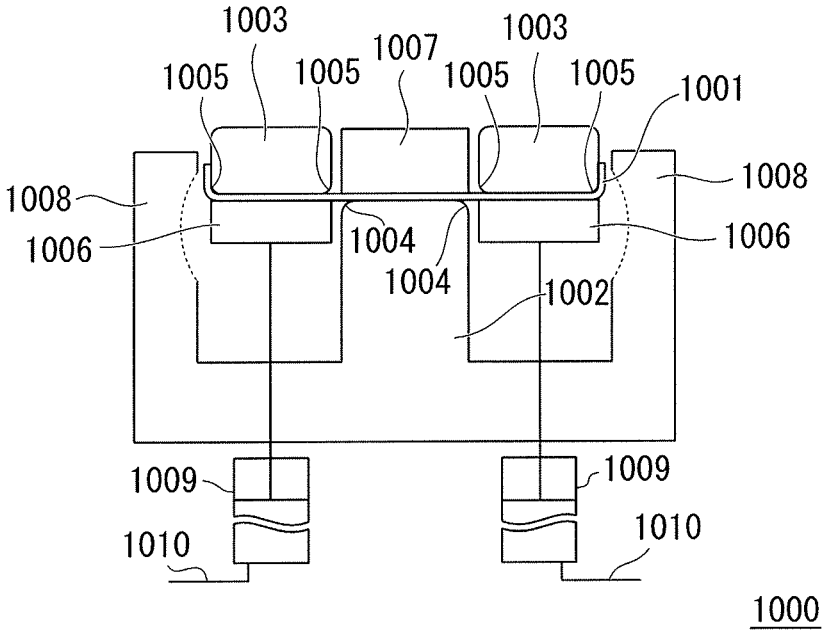
FIG. 9B PRIOR ART
FIG. 9B shows a second step of a press-forming method disclosed in the Patent Document 1.
Figure 9C:
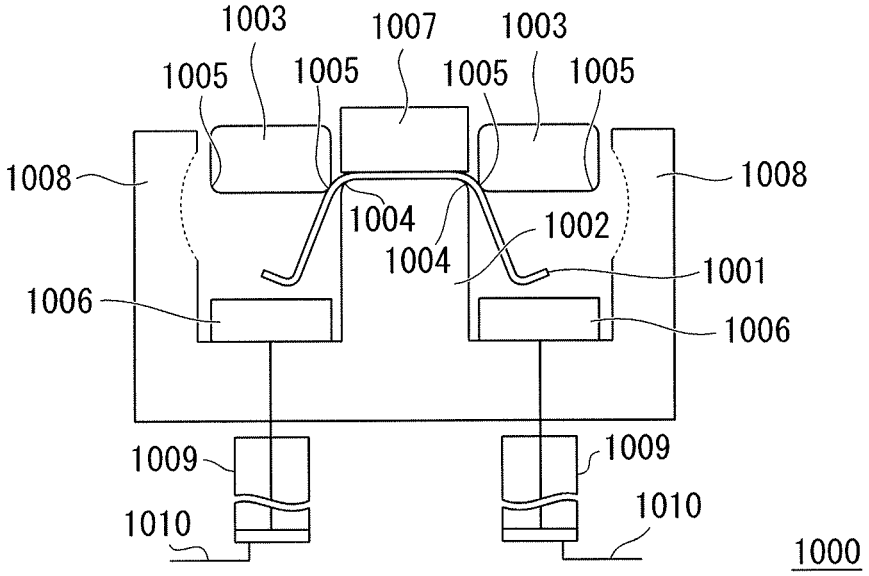
FIG. 9C PRIOR ART
FIG. 9C shows a third step of a press-forming method disclosed in the Patent Document 1.
Figure 9D:
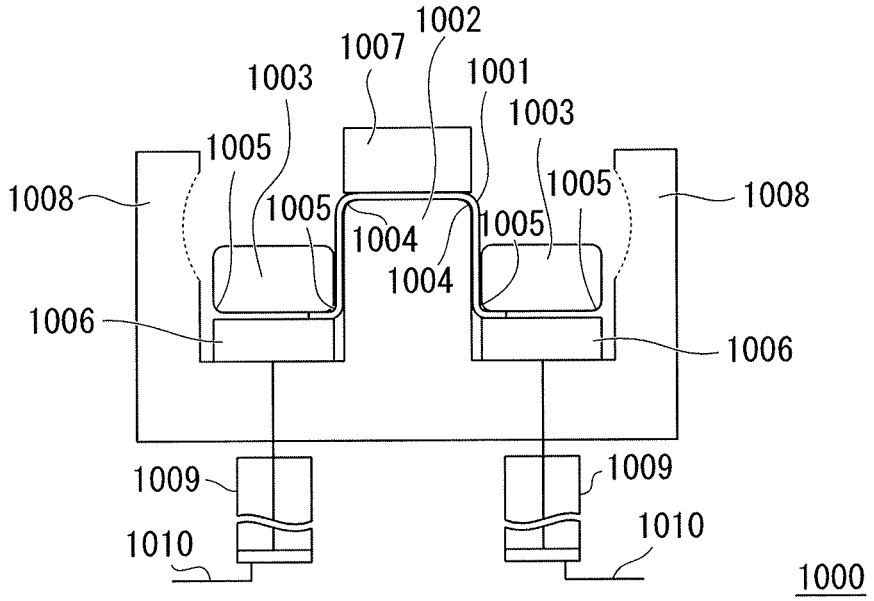
FIG. 9D PRIOR ART
FIG. 9D shows a fourth step of a press-forming method disclosed in the Patent Document 1.

Further, FIG. 7 is a graph showing a cushion stroke of the inner pad and an amount of the spring back in this instance.

As shown in a graph of FIG. 7, the opening amount is 1.7 mm when the cushion stroke of the punch pad 27 with respect to the shallower sidewall is 3 mm, and the opening amount is −0.2 mm when the cushion stroke of the punch pad 27 with respect to the deeper sidewall is 2 mm. Combining these amount, the total opening amount of the shallower and deeper sidewall is 0.9 mm, therefore, according to the press-forming method by using the press-forming apparatus according to the third embodiment (development method), it can be confirmed that the spring back can be suppressed so as to be practically used without a problem.

The specific examples of the present invention have been explained above based on the various embodiments and modifications, but the present invention should not be only limited to these examples. The present invention includes various modifications of the above specific examples.

In the above explanation, as an example, the insert block 19 includes the base end portion 19*a* and the tip end portion 19*b*. However, the insert block may not include the tip end portion 19*b*. In this case, when the second sidewall portion 105 is formed, a gap is generated between the die slide 11 and die pad 17, therefore, a pushing force may be applied to the steel sheet S from a die pad by using a die pad driving unit 17D.

In the above explanation, as an example, the steel sheet is used as a workpiece sheet. However, the workpiece sheet may be a plated steel sheet such as a galvanized steel sheet or a galvannealed steel sheet, or may be a metallic sheet such as an aluminum sheet or a titanium steel sheet, or a glass fiber strengthen resin sheet such as FRP or FRTP, or a composite sheet thereof.

In the above explanation, the die 10 is lowered. However, the punch 20, 20', 20" may be rose, or both of the die 10 and the punch 20, 20', 20" may be both rose and lowered so as to approach each other.

In the above explanation, the insert block 19 is inserted between the second divisional die 15 and the die slide 11, however, a configuration may be employed in which another insert block (not shown) is inserted between the first divisional die 13 and the die slide 11. In this case, a first divisional die driving unit (not shown) that drives the first divisional die 13 is provided between the die slide 11 and the first divisional die 13.

In the above explanation, the flange forming tools 30*a*, 30*b* are positioned so as to contact the upper face of the ground face 20*d* of the punch 20', 20". However, if the load of forming the flange portions 107*a*, 107*b* can be loaded, the flange forming tools 30*a*, 30*b* may not be positioned so as to be in contact with the upper face of the ground face 20*d* of the punch 20', 20".

In the above explanation, the height of the first sidewall portion 103 and the height of the second sidewall portion 105 are different. However, the height of the first sidewall portion 103 and the height of the second sidewall portion 105 may be the same.

In the above explanation, the flange forming tools 30*a*, 30*b* move in the horizontal direction, but may move in the obliquely downward direction (in the direction between the horizontal direction and the obliquely downward direction which inclines from the horizontal direction by about 30 degrees). This makes it possible to start the lowering of the die 10 when the flange forming tools 30*a*, 30*b* are being moved, and thus, the cycle time can be shortened.

In the above explanation, the flange portions 107*a*, 107*b* are formed on both sides for the press-formed article 100' having a hat type cross-section. However, the flange portion of the press-formed article may be formed only at one side.

In the above explanation, the vertical direction is the press-forming direction.

However, a press-forming apparatus in which lateral direction is a press-forming direction may be used.

INDUSTRIAL APPLICABILITY

According to the above aspects, it is possible to manufacture a high strength and/or long size press-formed article while suppressing the excessive amount of the maximum press-forming load and the excessive size of the press-forming apparatus in the press-forming direction.

EXPLANATION OF REFERENCE SYMBOLS

1, 1', 1" Press-forming apparatus
10 Die
11 Die slide
11A Suspending portion
13 First divisional die
13*a* Bottom end portion
15 Second divisional die
15*a* Bottom end portion
15D Second divisional die driving unit
17 Die pad
17D Die pad driving unit
19 Insert block
19*a* Base end portion
19*b* Tip end portion
19D Insert block driving unit
20, 20', 20" Punch
20*a* First side face
20*b* Second side face
20*c* Top face
20*d* Ground face
20A lateral wall portion
27 Punch pad
27D Punch pad driving unit
30*a*, 30*b* Flange forming tool
30D Flange forming tool driving unit
100, 100' Press-formed article
101 Top portion
102*a*, 102*b* Ridge portion
103 First sidewall portion
105 Second sidewall portion
106*a*, 106*b* Bending portion
107*a*, 107*b* Flange portion
S Steel sheet

What is claimed is:

1. A press-forming apparatus comprising a die and a punch, said apparatus being configured for manufacturing a press-formed article from a workpiece sheet by moving at least one of the die and the punch so as to be close to each other in a press-forming direction, the press-formed article having a top portion, a first sidewall portion, and a second sidewall portion, the first sidewall portion and the second sidewall portion being connected to ridge portions formed on both edges of the top portion, wherein the die comprises:

a die slide;

a first divisional die arranged at the die slide so as to be adjacent to a first side face of the punch in a state where the die and the punch are the closest to each other;

a second divisional die arranged at the die slide so as to be adjacent to a second side face of the punch in a state where the die and the punch are the closest to each other, the second side face being an opposite side face of the first side face;

a second divisional die driving unit configured to move the second divisional die in the press-forming direction so as to separate the second divisional die from the die slide;

a die pad arranged between the first divisional die and the second divisional die;

a die pad driving unit, including a pressing mechanism or an electrical motor, configured to move the die pad in the press-forming direction;

an insert block having a base end portion configured to be inserted between the die slide and the second divisional die in a state where the die slide and the second divisional die are separated from each other; and an insert block driving unit, including a pressing mechanism or an electrical motor configured to move the insert block in a direction perpendicular to the press-forming direction.

2. The press-forming apparatus according to claim 1, wherein the insert block has a tip end portion which extends from the base end portion in the direction perpendicular to the press-forming direction, and which is configured to be inserted between the die slide and the die pad in a state where the die slide and the die pad are separated from each other, and a thickness of the base end portion is thicker than a thickness of the tip end portion.

3. The press-forming apparatus according to claim 1, wherein the press-forming apparatus is configured to manufacture the press-formed article to have a flange portion which connects a bending portion formed on an edge of at least one of the first sidewall portion and the second sidewall portion.

4. The press-forming apparatus according to claim 3, comprising:

a flange forming tool arranged between the die and the punch; and a flange forming tool driving unit configured to move the flange forming tool between a position where a stroke range of the first divisional die or the second divisional die is interfered, and a position where a stroke range of the first divisional die or the second divisional die is not interfered, wherein an upper face of the flange forming tool and a lower face of at least one of the first divisional die and the second divisional die have a shape corresponding to a face shape of the bending portion and the flange portion.

5. The press-forming apparatus according to claim 4, wherein the flange forming tool driving unit is configured to move the flange forming tool into the direction perpendicular to the press-forming direction.

6. The press-forming apparatus according to claim 4, wherein a lower face of the flange forming tool is in surface-contact with a ground face of the punch.

7. The press-forming apparatus according to claim 1, comprising:

a punch pad configured to be housed in a recessed portion formed in a top face of the punch, and a punch pad driving unit configured to move the punch pad in the press-forming direction.

8. The press-forming apparatus according to claim 1, wherein the first divisional die is formed integrally with the die slide.

9. The press-forming apparatus according to claim 1, wherein the die slide is connected to a single driving shaft.

10. The press-forming apparatus according to claim 1, wherein the press-forming apparatus is configured to form the press-formed article from a workpiece sheet that is a steel sheet.

11. The press-forming apparatus according to claim 1, wherein the press-forming apparatus is configured to form the press-formed article from a workpiece sheet having a tensile strength not less than 980 MPa.

12. The press-forming apparatus according to claim 1, wherein the press-forming apparatus is configured to form the press-formed article from a workpiece sheet having a total length more than 1700 mm.

13. A press-forming method for manufacturing the press-formed article by using the press-forming apparatus according to claim 1, the press-forming method comprising;

forming the first sidewall portion by positioning the insert block outside an area between the die slide and the second divisional die and then moving the die slide toward the punch; and forming the second sidewall portion by positioning the insert block within the area between the die slide and the second divisional die and then moving the die slide toward the punch.

14. The press-forming method according to claim 13, further comprising:

after performing the forming of the first sidewall portion, inserting the insert block in the area between the die slide and the second divisional die, and then performing the forming of the second sidewall portion.

15. The press-forming method according to claim 14, wherein in the forming of the first sidewall portion, a portion in the workpiece sheet corresponding to the second sidewall portion is pre-formed by using the second divisional die.

16. The press-forming method according to claim 13, wherein after performing the forming of the second sidewall portion, pulling the insert block out of the area between the die slide and the second divisional die, and then performing the forming of the first sidewall portion.

17. The press-forming method according to claim 16, wherein in the forming of the second sidewall portion, a portion in the workpiece sheet corresponding to the first sidewall portion is pre-formed by using the first divisional die.

18. The press-forming method according to claim 13, wherein before performing the forming of the first sidewall portion and the forming of the second sidewall portion, the die slide is relatively moved toward the punch in a state where a flange forming tool is arranged at a position interfering with a stroke range of the first divisional die and the second divisional die, thereby forming a flange portion in the workpiece sheet by using the flange forming tool and at least one of the first divisional die and the second divisional die.

19. The press-forming method according to claim 13, wherein in at least one of the forming of the first sidewall portion and the forming of the second sidewall portion, the die slide is lowered in a state where a punch pad configured to be housed in a recess portion formed in a top face of the punch is positioned high above a top face of the punch, and the punch pad is lowered in accordance with the lowering of the die slide to complete a press-forming.

* * * * *